US006179462B1

(12) United States Patent
Böltner-Brand et al.

(10) Patent No.: US 6,179,462 B1
(45) Date of Patent: Jan. 30, 2001

(54) DEVICE FOR THE PRODUCTION OF SOLID AND/OR SOLID-LIQUID MIXTURE HAVING A DISCHARGE DOOR

(75) Inventors: Werner Böltner-Brand; Heinz-Dieter Hagemeier, both of Paderborn (DE)

(73) Assignee: Gebrüder Lödige Maschinenbau-Gesellschaft mit beschränkter Haftung, Paderborn (DE)

( * ) Notice: Under 35 U.S.C. 154(b), the term of this patent shall be extended for 0 days.

(21) Appl. No.: 09/239,544

(22) Filed: Jan. 29, 1999

(30) Foreign Application Priority Data

Mar. 28, 1998 (DE) ..... 198 13 867

(51) Int. Cl.[7] ..... B01F 15/02
(52) U.S. Cl. ..... 366/192
(58) Field of Search ..... 366/184, 189, 366/192, 42, 77, 194–196

(56) References Cited

U.S. PATENT DOCUMENTS 624,200 * 5/1899 Fisher .
631,782 * 8/1899 Fisher .
4,572,674 * 2/1986 Mathis et al. .
5,063,840 * 11/1991 Vote .
5,193,444 * 3/1993 Bar-Sheshet .
5,249,861 * 10/1993 Thomson .

FOREIGN PATENT DOCUMENTS 32 36 780 C2 4/1984 (DE) .

* cited by examiner

*Primary Examiner*—Charles E. Cooley
(74) *Attorney, Agent, or Firm*—Paul Vincent

(57) ABSTRACT

A device for the production of solid mixtures comprises a mixing drum 12 having a rectangular opening 20. The rectangular opening 20 is bordered by a first edge 18 lying in a plane. A seal 21 is disposed in the vicinity of the first edge 18 which likewise lies in a plane and which borders and completely surrounds the rectangular opening 20 both in the vicinity of the mixing drum 12 as well as in the vicinity of the end walls 11. The rectangular opening 20 extends over the entire mixing region 15 and is sealed by one single door 16 in a dust-tight manner. The door 16 is bordered by the second edge 19 which likewise lies in a plane and which seats on the first edge 18 when the door 16 is closed.

11 Claims, 2 Drawing Sheets

DEVICE FOR THE PRODUCTION OF SOLID AND/OR SOLID-LIQUID MIXTURE HAVING A DISCHARGE DOOR

This application claims Paris Convention Priority of German patent application number 198 13 867.9 filed Mar. 28, 1998, the complete disclosure of which is hereby incorporated by reference.

BACKGROUND OF THE INVENTION

The invention concerns a device for the production of solid and/or solid-liquid mixtures in a mixer having a substantially cylindrical horizontally directed mixing drum comprising end walls defining a mixing region of the mixing drum, with mixing tools disposed in the mixing region which mix the product components located in the mixing region during operation of the device and having at least one opening provided in the cylinder wall extending over the entire axial length of the mixing region for suppling and/or discharging the mixing region, wherein the opening can be closed for operation of the device.

A mixing device of this kind has become known in the art through German patent publication DE 32 36 780 C2.

The conventional device for mixing of solids has a two-part discharge door in the floor region of the mixer which can be opened along nearly the entire floor region. The discharge doors must adapt to the cylindrical-shaped mixing volume in the closed state so that they must be curved in correspondence with the drum radius. Both the curved edges as well as the linearly extending edges of the discharge doors must be sealed relative to the mixing region to seal the conventional mixer in a dust-tight manner during operation. Towards this end, seals are provided in the edges of the door. When the mixing region is discharged, it is then necessary for the doors to be opened and the product flowing out also covers the seals on the doors so that the seals can be become damaged as well as soiled by the discharging product. It is therefore necessary to clean the seals after each batch or after several batches to maintain dust-tight sealing of the mixing region by the doors. In addition, the seals extend along curved surfaces of the doors or of the drum sections and are constantly in motion along with the doors.

It is therefore the purpose of the present invention to create a simplified sealing surface at a large area opening of a cylindrical-shaped mixing region which is largely maintenance-free and inexpensive to produce.

SUMMARY OF THE INVENTION

This purpose is achieved in accordance with the invention in that the opening in the mixing drum is bordered by a first edge which extends at least partially into the end walls with the first edge extending in the cylinder wall and in the end walls within a plane.

The configuration of the opening on a mixing region in accordance with the invention has the advantage that curved edges no longer border the opening. A linear edge is formed along the entire periphery of the opening which lies in a plane. The first edge extending in a plane borders an opening which extends over the entire mixing region to facilitate complete discharge of the residual product located in the mixing region. The mixing region has no portion in the floor region which is not completely freed when the door is opened. The flat edge dependence also facilitates a simple door construction to allow the opening to be sealed in a dust-tight manner, since only a peripheral edge lying in a plane must be sealed. Not only small machines can therefore operate with one single door which can effectively close the entire opening if required. This advantage facilitates economical manufacture of the door as well as the opening to be created at the mixing region. When the opening can be satisfactorily closed by only one single door, only one single locking and opening mechanism is required for moving the door into a closing or into an opening position.

In an additional preferred embodiment of the invention, the opening can be closed via a door having a bulge whose inner surface ends in a peripheral edge lying in a plane which seats on the first edge in a closed state of the door and the inner surface of the bulge extends directly and without steps into an inner surface of the bordering cylindrical wall of the mixing drum.

This has the advantage that by no dead zones can occur in the mixing region during a mixing process. The second edge lying in a plane can be simply pressed onto the first edge to seal the opening. The bulge in the one single door facilitates a continuous extension of the cylindrical-shaped mixing region dependence so that mixing elements in close proximity to the inner surface can also effectively sweep over the inner surface of the bulge during operation of the device to frequently move the material to be mixed. The opening can be closed without gaps along the first and s econd edges so that when the edges are ground flat, the mixing region c an be properly sealed without additional seals when the two edges seat tightly against each other. The width of the edges can be freely chosen according to need.

In a further improvement of the invention, a seal is disposed between the first and the second edges.

This has the advantage that a more complete sealing of the mixing region is guaranteed via the seal even when the finest of dusts are processed.

The seal is preferentially disposed in the vicinity of the first edge.

This has the advantage that the seal must no longer be moved along with the door and is removed from the production flow. The seal can be disposed behind the border of the first edge, and the planar dependence of the first edge guarantees simple attachment of the seal.

In a further embodiment of the invention, the seal is configured as a rectangular endless peripheral sealing band. The sealing band can be configured as a closed band having a quadratic, round or rectangular cross-section. In particular, flat sealing bands can also be accommodated on the first edge.

In a particularly preferred embodiment of the device, a metal band is disposed along the first edge in the vicinity of the mixing drum and directed outwardly in the plane defined by the first edge in which a groove is provided for accepting the seal.

This has the advantage that the first edge is stiffened in the region of the opening. In addition, the seal can be introduced at a separation from the border of the first edge. A groove is formed in the metal band which likewise lies in the plane of the first edge for accepting the seal in a precise fashion. Depending on its width, the metal band can present a large area seating surface for the second edge of the door so that a very good sealing of the opening is guaranteed when the door is closed.

In the event that the metal band is supported by a brace, an additional stiffening in the vicinity of the seal is achieved. The second edge of the door can be pressed with a stronger sealing strength against the first edge.

End surfaces are preferentially fashioned on the end walls in the plane of the first edge having a width which is at least sufficient for the acceptance of a seal within a groove fashioned in one of the end surfaces.

This has the advantage that the same seal can be inserted into the end surfaces of the end walls that is used in the remaining part of the first edge. The first edge extends peripherally about the entire opening and also in the end walls. The end surfaces correspond to the first edge.

In an additional configuration of the invention, the end walls are formed from round members which end in the plane of the first edge and from wall members which project beyond the round members.

This has the advantage of providing an easy method with which the end surfaces on the end walls can be created for the first edge, and the projecting wall members facilitate configurations for the device which allow the walls to be used as constructive support members for the device or as acceptance plates for additional instruments which are to be introduced onto the device.

Should a stiffening angle be provided along the mixing drum between the end walls at least at one lengthwise side of the mixing drum, a sufficient stiffening of the entire device is guaranteed even for smaller mixing drum wall thicknesses.

A shaft is provided on the mixing drum in the vicinity of the stiffening angles for pivoting-out the door to open and to close the opening. The forces necessary for opening and closing the door can be generated by hydraulic or pneumatic closing cylinders. The stiffening angle additionally guarantees that no intolerable torques act on the device when the shaft is turned.

An additional blower device can be disposed in the vicinity of the first edge in order to clean, e.g. using pressurized air, the first and second edges completely automatically prior to closing the door.

Further advantages of the invention can be extracted from the subsequent description of an embodiment with reference to the drawing which show details important to the invention as well as from the claims. The individual features can be utilized in embodiments of the invention individually or collectively in arbitrary combination.

DESCRIPTION OF THE PREFERRED EMBODIMENT

The invention is shown in the figures in a highly schematic fashion so that the essential features of the invention can be easily seen. The representations are not necessarily to be taken to scale.

Figure 1:
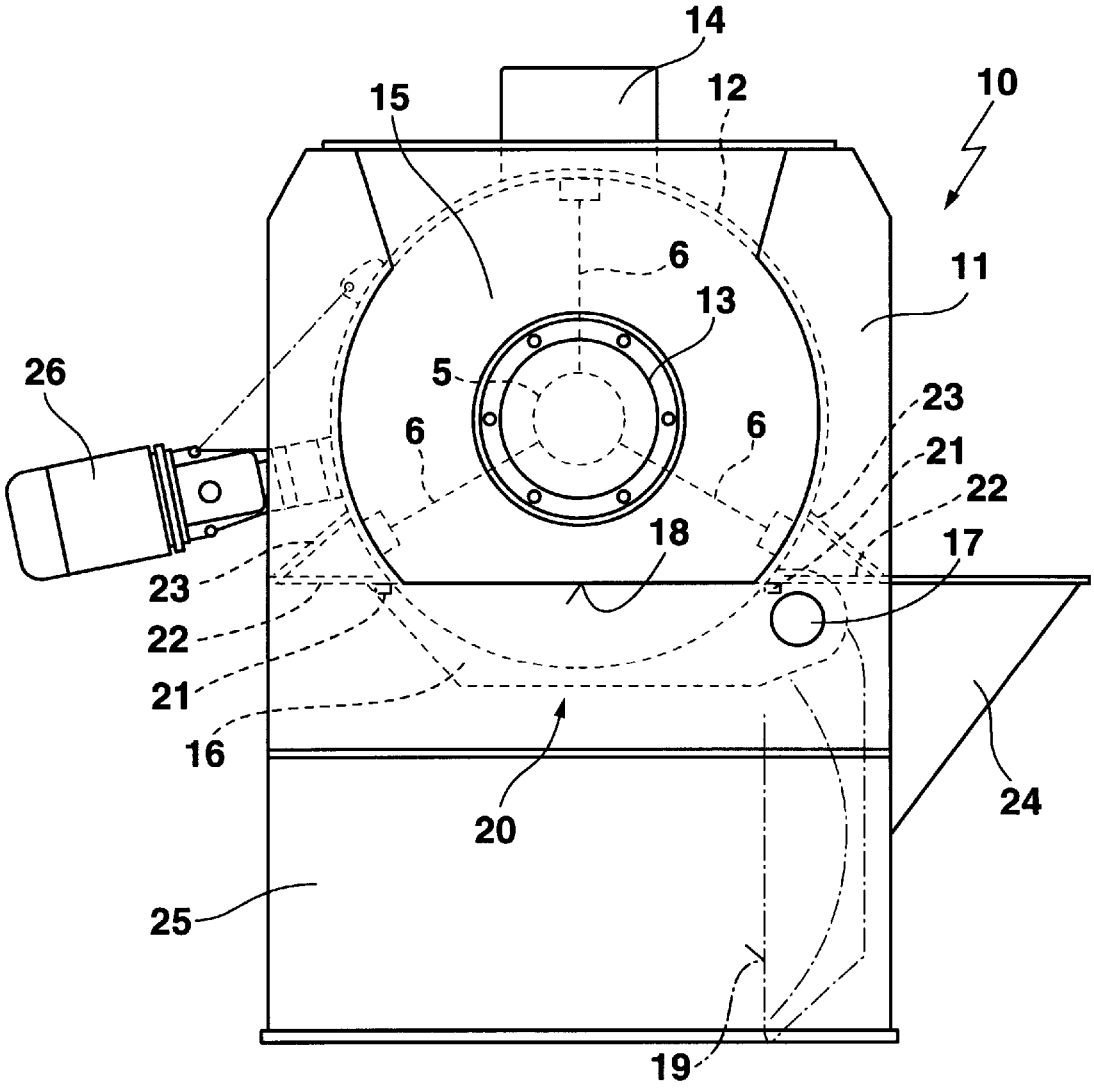
FIG. 1 shows a device in accordance with the invention in an end wall view.

FIG. 1 shows an end wall 11 view of a mixer 10. The end wall 11 connects to a mixing drum 12. An additional end wall limits the drum 12 in the axial direction. A bearing 13 is disposed in the end wall 11 for a mixing shaft 5 upon which mixing tools 6 are disposed. The mixing shaft 5 extends through the entire mixing drum 12 and is borne for rotation at each of its ends in an end wall 11.

A product supply chute 14 is disposed on the mixing drum 12 to introduce solids and liquids to be mixed into a mixing region 15. The mixing region 15 is defined by the mixing drum 12 and the end walls 11.

A door 16 is provided for in a floor region of the mixing drum 12 which extends along the entire axial length of the mixing region 15. The door 16 is borne on the mixer 10 for rotation via a shaft 17.

A first edge 18 and a second edge 19 border an opening 20 which is formed in the floor region of the mixing drum 12. The peripheral second edge 19 borders the door 16, and the peripheral first edge 18 borders the opening 20 on the mixing drum 12 and on the end walls 11.

A seal is provided for on the first edge 18 which is attached to a metal band 22. The metal band 22 is firmly connected to the first edge 18. The metal band 22 is stiffened by means of a brace 23.

A stiffening angle 24 is provided on the mixer 10 which stiffens the mixer 10 in the vicinity of the bearing for the door 16. The end walls 11 extend into a support structure 25 with which the mixer 10 can seat on a floor. A cutting head 26 is also flanged onto the mixing drum 12 which projects into the mixing region 15 with rapidly rotating blades.

The rapidly rotating blades of the cutting head 26 can support the mixing process within the mixing region 15. The door 16 is shown in the figure in a closed state using dashed lines. The second edge 19 seats in a sealing fashion on the first edge 18 of the opening 20, and the seal 21 is disposed between the first edge 18 and the second edge 19. Dotted dashed lines indicate the door 16 in the opened state.

Figure 2A:
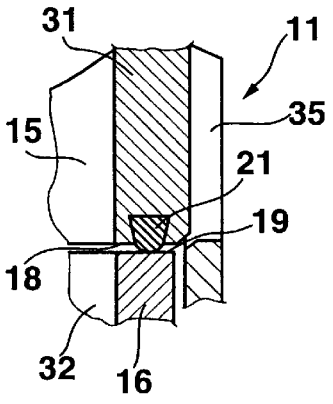
FIG. 2*a* shows a detailed representation in the vicinity of arrow direction IIa of FIG. 2.
Figure 2:
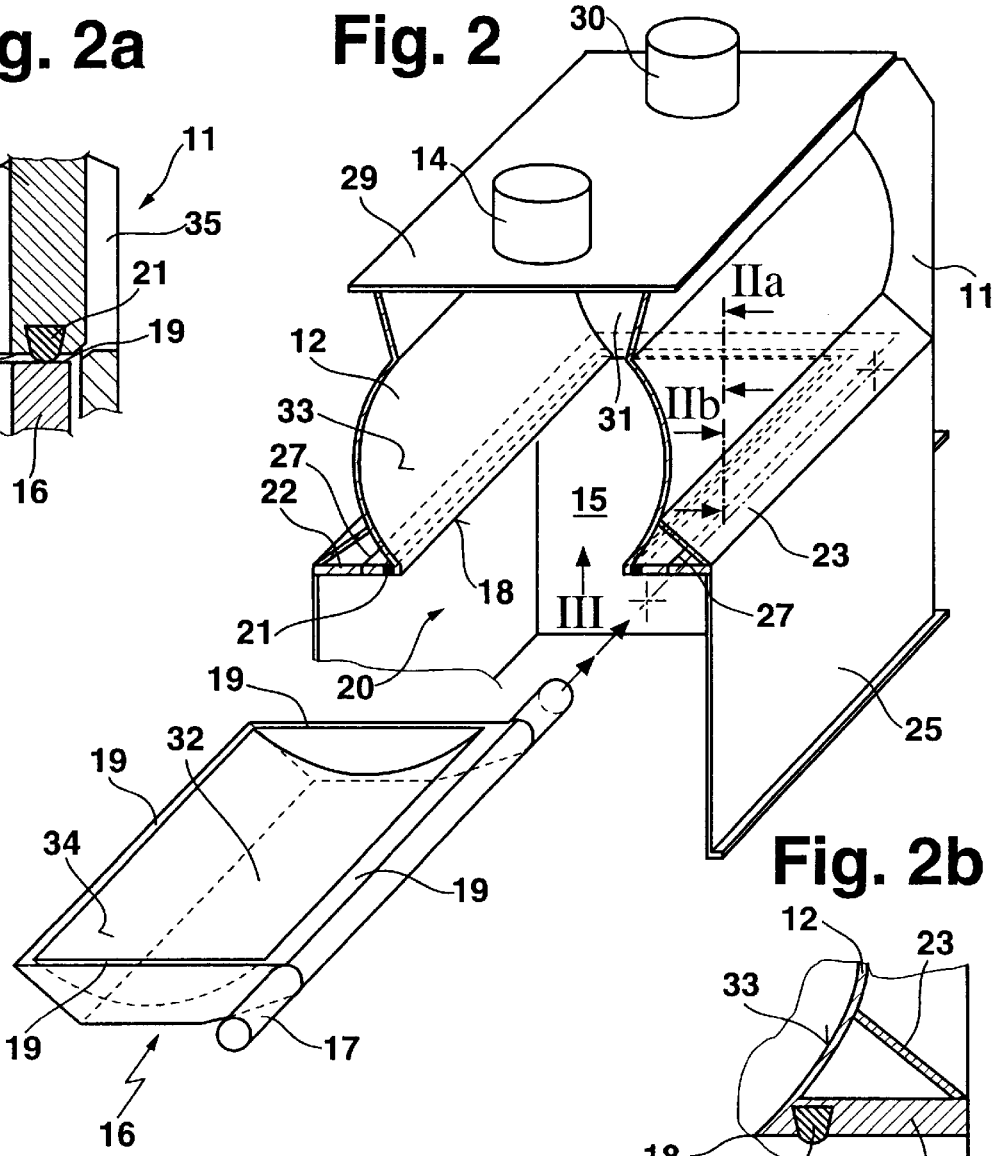
FIG. 2 shows individual portions of the device in accordance with the invention of FIG. 1 which are important to the invention.

FIG. 2 shows only individual portions of the mixer 10 in a perspective view. The door 16 is shown displaced relative to the mixing region 15. The mixing region 15 is bordered from above by a plate 29 on which the product supply chute 14 and a vent chute 30 are disposed. In order to better illustrate the features important to the invention, only one end wall 11 is shown in the figure. The mixing drum 12 is defined at each end by an end wall 11 in which the mixing shaft 5 is borne. The mixing drum 12 ends in the lower region in a peripheral first edge 18 which surrounds the opening 20 and lies in a plane. The seal 21 extends within the metal band 22 adjacent to the first edge 18. The seal 21 travels within the metal band 22 and in the end walls 11 in a horizontal plane. The seal 21 is introduced into the end surface of a rounded section 31 in the vicinity of the end wall 11.

The door 16 has a bulge 32 adapted to the mixing region 15. When the door 16 is adapted to the mixing drum 12, an inner surface 33 of the mixing drum 12 maps smoothly into an inner surface 34 of the door 16 when the door 16 is closed.

A brace 23 is provided for on the metal band 22 for stiffening purposes. The metal band 22, as shown in the figure, is connected to a support structure 25.

A blower device 27 is fashioned in the vicinity of the first edge 18. The blower device 27 provides pressurized air to automatically clean the first 18 and second 19 edges before the door 16 is closed.

FIG. 2*a* shows a detailed view in the vicinity of the end wall 11 in accordance with view IIa of FIG. 2. The end wall 11 is formed from the rounded member 31 and the wall 35. The rounded member 31 ends in an end surface forming the first edge 18. The seal 21 is disposed in the first edge 18. The seal 18 is shown slightly separated from the second edge 19. The door 16 is pressed with the second edge 19 firmly onto the seal 21 and the first edge 18 to seal the mixing region 15 in a dust-tight fashion. The bulge 32 thereby smoothly borders the mixing region 15.

Figure 2B:
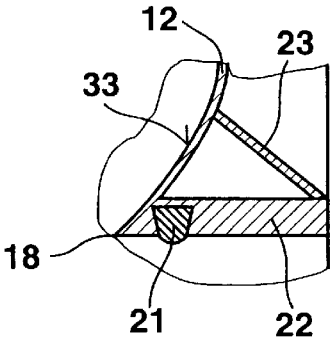
FIG. 2*b* shows a detailed representation in the vicinity of arrow direction IIb of FIG. 2.

FIG. 2*b* shows a detail of FIG. 2 in accordance with the view in arrow direction IIb. The inner surface 33 of the cylinder wall ends in the first edge 18. The metal band 22 likewise borders the first edge 18. A groove is formed in the metal band 22 in which the seal 21 extends. The metal band 22 is supported via the brace 23 relative to the mixing drum 12.

Figure 3:
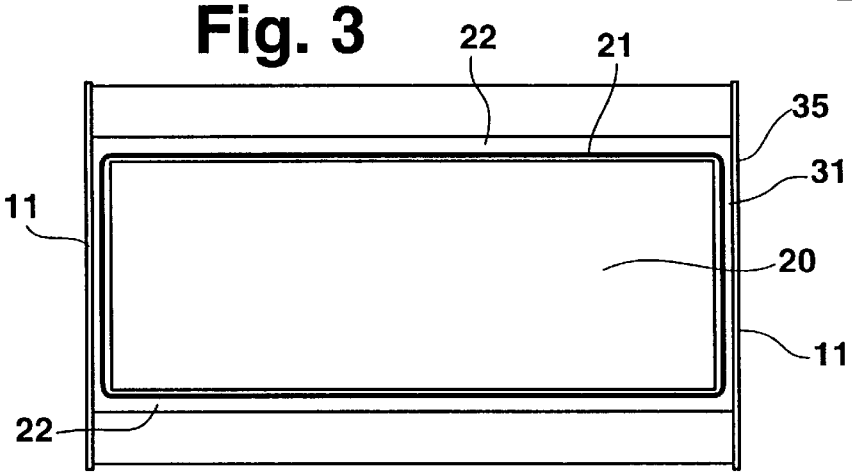
FIG. 3 shows a view in the vicinity of arrow direction III of FIG. 2.

FIG. 3 shows a view in arrow direction III of FIG. 2. The opening 20 is bordered in a plane by the endless peripheral seal 21 accommodated in the metal band 22 and in the end surfaces of the rounded member 31. The end walls 11 are each formed by the rounded member 31 and the wall 35.

A device for the production of solid mixtures comprises a mixing drum 12 having an opening 20. The opening 20 is bordered by a first edge 18 which lies in a plane. A seal 21 is disposed in the vicinity of the first edge 18 which likewise extends in a plane and which surrounds the opening 20 both in the vicinity of the mixing drum 12 as well as in the vicinity of the end walls 11. The opening 20 extends over the entire mixing region 15 and can be sealed by the door 16 in a dust-tight manner. The door 16 is bordered by the second edge 19 which likewise extends in a plane and which seats on the first edge 18 when the door 16 is closed.

What is claimed is:

1. A device for processing product components to produce solid and liquid mixtures, the device comprising:

a first end wall;

a second end wall;

a substantially horizontal cylindrical drum having a first longitudinal side and a second longitudinal side opposite to said first longitudinal side, said drum connected between said first end wall and said second end wall to define a mixing region, wherein said drum has a substantially rectangular opening extending along an entire axial length of said mixing region, said opening bordered by a first edge extending along said first end wall, said first longitudinal side, said second end wall and said second longitudinal side to define a continuous, substantially rectangular and planar first sealing surface;

mixing tools disposed within said mixing region to mix the product components; and one single door having a bulge in an inner surface thereof which ends in a second edge, said second edge extending about an entire periphery of said door to define a continuous, substantially rectangular and planar second sealing surface, said second sealing surface seating on said first sealing surface when said door is in a position closing said rectangular opening of said drum, wherein said inner surface of said bulge maps smoothly into an adjacent inner surface of said drum.

2. Device of claim 1, further comprising a seal disposed between said first edge and said second edge.

3. The device of claim 2, wherein said seal is disposed proximate said first edge.

4. The device of claim 2, wherein said seal comprises an uninterrupted rectangular sealing band surrounding said rectangular opening of said drum.

5. The device of claim 2, further comprising an outwardly directed metal band disposed along said first edge proximate said drum, said band coplanar with said first edge, said band having a groove for accepting said seal.

6. The device of claim 5, further comprising a brace for supporting said metal band.

7. The device of claim 2, wherein at least one of said first and said second end walls has a groove for accepting said seal.

8. The device of claim 7, wherein each of said first and said second end walls comprises a round member ending at said first edge and a wall member external to said round member.

9. The device of claim 1, further comprising a stiffening angle disposed along said drum between said first and said second end walls proximate one end of said first and said second longitudinal sides of said drum.

10. The device of claim 9, further comprising a shaft proximate said stiffening angle to pivot said door for opening and closing said rectangular opening of said drum.

11. The device of claim 1, further comprising a blower device disposed proximate said first edge.

* * * * *